US006935851B2

(12) United States Patent
Peters et al.

(10) Patent No.: US 6,935,851 B2
(45) Date of Patent: Aug. 30, 2005

(54) EXTERNAL GEAR PUMP WITH PRESSURE FLUID PRE-LOADING

(75) Inventors: Dieter Peters, Bad Schussenried (DE); Robert Laux, Bad Schussenried (DE); Herbert Ailinger, Bad Schussenried (DE); Lothar Preisler, Bad Schussenried (DE); Sven Peters, Eberhardzell (DE); Christof Lamparski, Mittelbiberach (DE)

(73) Assignee: Schwäbische Hüttenwerke GmbH, Aalen-Wasseralfingen (DE)

( * ) Notice: Subject to any disclaimer, the term of this patent is extended or adjusted under 35 U.S.C. 154(b) by 0 days.

(21) Appl. No.: 10/651,348

(22) Filed: Aug. 28, 2003

(65) Prior Publication Data

US 2004/0228752 A1 Nov. 18, 2004

(30) Foreign Application Priority Data

Aug. 28, 2002 (DE) ..... 102 39 558

(51) Int. Cl.[7] ..... F03C 2/00

(52) U.S. Cl. ..... 418/15; 418/140; 418/180; 418/206.1; 417/310

(58) Field of Search ..... 418/15, 180, 206.1, 418/140, 149; 417/310

(56) References Cited

U.S. PATENT DOCUMENTS 2,301,496 A * 11/1942 Aldrich ..... 417/310
2,412,588 A * 12/1946 Lauck ..... 418/15
2,489,887 A * 11/1949 Houghton ..... 418/180
4,480,970 A * 11/1984 Smith ..... 418/15
4,671,749 A * 6/1987 Naraki et al. ..... 418/201.1
6,312,240 B1 * 11/2001 Weinbrecht ..... 418/180

FOREIGN PATENT DOCUMENTS

| | | |
|---|---|---|
| CH | 157744 | 10/1932 |
| CH | 305522 | 2/1955 |
| DE | 644 570 | 4/1937 |
| DE | 1553014 | 8/1969 |
| DE | 2116317 | 10/1972 |
| JP | 63005190 A | 1/1988 |

* cited by examiner

*Primary Examiner*—Theresa Trieu

(57) ABSTRACT

External gear pump, comprising: a casing (3*a*, 3*b*) with a gear chamber (4), comprising an inlet (5) for a fluid on a low pressure side and an outlet (6) on a high pressure side and comprising axial and radial sealing stays (7, 8); toothed wheels (1, 2) being in toothed mesh, wherein the external toothings of the wheels (1, 2) form delivery cells (10) for the fluid which are axially sealed off by the axial sealing stays (7) and radially sealed off by the radial sealing stays (8); and at least one pressure fluid supply (15, 16) through which pressure fluid may be supplied to the low pressure side, wherein the at least one pressure fluid supply (15, 16) opens on the low pressure side into a delivery cell (10) which is radially opposed by one of the radial sealing stays (8).

16 Claims, 2 Drawing Sheets

EXTERNAL GEAR PUMP WITH PRESSURE FLUID PRE-LOADING

CROSS REFERENCE TO RELATED APPLICATIONS

This application claims priority based upon German Patent Application Serial Number 102 39 558.6, filed on Aug. 28, 2002.

TECHNICAL FIELD

The invention relates to external gear pumps for use for example as lube oil pumps for internal combustion piston motors.

BACKGROUND OF THE INVENTION

Cavitation is a constant problem in fluid pumps. Cavitation is caused in particular when the tooth gap spaces are incompletely filled. As the speed of the toothed wheels of the pump increases, so the centrifugal force which acts on the fluid to be delivered in the tooth gap spaces also increases, such that the degree of filling drops. The result is cavitation and, as a consequence, significant noise development.

It is an object of the invention to reduce cavitation and noise in external gear pumps.

BRIEF SUMMARY OF THE INVENTION

The invention relates to an external gear pump comprising a casing in which a gear chamber is formed with an inlet and an outlet for a fluid to be delivered, and a gear running carriage consisting of at least two externally toothed spur wheels which, when rotationally driven, mate with each other. The fluid suctioned through the inlet of the gear chamber when the toothed wheels are rotationally driven fills the tooth gap spaces of the external toothings and is transported by the rotating toothed wheels to the outlet of the gear chamber, and there expelled at high pressure due to the closing toothed mesh of the toothed wheels. Between the inlet and the outlet, the tooth gap spaces of the external toothings form delivery cells for the fluid. The delivery cells are defined axially, i.e. with respect to the facing sides of the toothed wheels, by axial sealing stays and radially, i.e. over an angular range along the periphery of the toothed wheels, by radial sealing stays. Sealing gaps inevitably remain between the toothed wheels and the sealing stays, however the sealing gaps are sufficiently narrow to separate a high pressure side of the gear chamber which includes the outlet from a low pressure side which includes the inlet. In this sense, the sealing stays seal the delivery cells and the inlet off from the outlet.

The pump further comprises a pressure fluid supply, through which pressure fluid can be supplied to the low pressure side. The pressure fluid is preferably the fluid of the high pressure side of the pump, delivered by the pump, wherein the high pressure side of the pump is understood to mean not only the high pressure side of the gear chamber but also the high pressure part of the fluid system connected to it, in which the pump delivers the fluid. This high pressure part extends at least up until directly behind the last unit to be supplied with the fluid by the pump. In this case, the pressure fluid supply is a pressure fluid feedback. In principle, however, it would also be conceivable to supply a fluid pressurised in another way. The fluid to be delivered and the pressure fluid are preferably hydraulic liquids; particularly preferably, they are the same fluid.

In preferred applications of the external gear pump as a lube oil pump for internal combustion piston motors, in particular linear piston motors, or as a supply pump of an automatic transmission, the pump is in most cases driven by the motor in proportion to the motor speed, often at the motor speed. Due to the specific delivery volume of external gear pumps, which is in practice constant, the absolute delivery volume of the pump correspondingly increases proportionally with increasing motor speed. However, the lube oil requirement of the motor only increases proportionally with increasing motor speed up to a motor-specific speed, for example up to about 4000 r/min, and then remains constant or increases substantially more slowly. In the speed range above the bend in the requirement curve, therefore, the delivery volume of the pump is greater than the actual requirement. The excess lube oil is mostly simply diverted and is fed back to an oil reservoir, with the associated loss of energy. This also applies analogously to an automatic transmission's requirement for hydraulic liquid. In such applications, as in principle in other applications in which the delivery volume of the pump is greater than the actual requirement, thus also for example as a hydraulic pump for supplying an automatic transmission of a vehicle, it is therefore preferable if the pressure fluid fed back to the low pressure side is removed before the unit to be supplied. Particularly preferably, the pressure fluid is removed while it is still in the gear chamber, from the high pressure side, or at least before the casing outlet. In this case, the pressure fluid supply can advantageously be formed alone by one or more pressure fluid conduits in the pump casing.

In accordance with the invention, the pressure fluid is supplied to a delivery cell which has already moved into the rotational angle range enclosed by one of the radial sealing stays (enclosure area), when the toothed wheels are rotationally moved. The pressure fluid supply accordingly opens into a delivery cell which is radially opposed by a radial sealing stay. Such a pressure fluid supply is preferably provided for each of the at least two toothed wheels of the gear running carriage. If the pump comprises more than two toothed wheels, then pressure fluid is preferably guided into the respective enclosure area for each of the toothed wheels.

By specifically pre-loading into the enclosure area in accordance with the invention, the problem of cavitation is substantially more effectively counteracted than by simply supplying a pressure fluid into the inlet or suction area of the gear chamber, upstream of the radial sealing stays. If the pressure fluid were simply supplied into the suction area, i.e. into the area in which the tooth gap spaces of the toothed wheels are not yet immersed in the enclosure formed by the radial sealing stays and therefore sealed off as delivery cells, then the pressure fluid would be mixed and swirled with the further suctioned fluid and would be exposed in the tooth gap spaces to the centrifugal force acting therein. Only by supplying the pressure fluid in the area of the enclosure in accordance with the invention are the delivery cells effectively loaded with the pressure fluid. Since loading takes place while still on the low pressure side, this may be called pre-loading.

The pressure fluid guided into the delivery cells is more highly pressurised than the fluid already contained in the delivery cell. Due to its higher pressure, the gaseous portion of the pressure fluid is more completely dissolved than the gaseous portion of the fluid already contained in the delivery cell beforehand. If the pressure fluid is the fluid from the high pressure side of the pump, then this necessarily means that fewer gas bubbles are formed in the pre-loaded delivery cells than in the non-pre-loaded delivery cells in the prior art. The problem of cavitation, essentially noise and pitting, is therefore reduced. The onset of cavitation is shifted to higher speeds.

The pressure fluid supply can open in one or both axial sealing stays of the toothed wheel, i.e. on both facing sides of a toothed wheel, or in the radial sealing stay or in both types of sealing stays.

Furthermore, it is preferable if the pressure fluid is fed into an axial end section of the delivery cell and a relieving space is connected to the other, opposing axial end of the delivery cell, into which the fluid contained in the delivery cell before loading in accordance with the invention can be expelled. The relieving space is preferably connected to the suction area of the gear chamber or the flow area directly connected upstream of the inlet. The pressure fluid can also be supplied in an axially central section of the delivery cell, and in this case a relieving space in the form of a drain can expediently be provided at both axial end sections of the delivery cell. The reverse arrangement, namely the supply at one or both end sections and the drain in the central section, is in principle also conceivable. The supply for the pressure fluid and the drain for the expelled fluid, or the number of supplies and/or drains as the case may be, should be formed such that the delivery cell is filled as completely as possible with the pressure fluid and only the low pressure fluid is expelled from the delivery cell. The pressure fluid supply opening should therefore be separated from the suction area in the circumferential direction of the toothed wheel in question by at least one, preferably exactly one, tooth tip of the toothed wheel. Filling the delivery cell in question as completely as possible with the pressure fluid means that pressure fluid does not or only negligibly flows off from the pre-loaded delivery cell into the suction area. Preferably, exactly the fluid delivered surplus to the requirement of the consumer or number of consumers is fed back under the pressure of the high pressure side and completely utilised for pre-loading.

The inlet into the gear chamber or the suction area incorporating the inlet can directly form the relieving space. In this way, an end edge of the radial sealing stay, in the area of which stay the pressure fluid is supplied, can point at an angle to the external toothing of the toothed wheel enclosed by said sealing stay or can comprise a recess extended in the rotational direction of the toothed wheel, preferably in an axial end area of the radial sealing stay. In both cases, the radial sealing stay provided with such an end edge only encloses an axial section of the immersing delivery cell, while another axial section, preferably an axial end section, of the immersing delivery cell is still open towards the suction area. The pressure fluid is supplied to the immersing delivery cell in the already enclosed axial section, while the fluid already contained beforehand in the enclosed axial section is expelled back into the suction area by the pressure fluid streaming into the cell. A drain formed simply in this way, for the expelled fluid, is provided in a particularly simple way if the toothed wheels of the gear running carriage which mate with each other have a single or multiple helical or screw toothing. In the case of such toothings, it is sufficient if the end edge of the radial sealing stay formed in the suction area simply runs linearly in the axial direction. The end edge preferably has a small radius, such that it is an edge in the narrower sense of the word. Rounded, i.e. gradually tapering ends are, however, also to be covered by the term, though less preferred.

The pressure fluid supply opening is preferably formed such that the tooth of the delivery cell loaded last, trailing in the rotational direction of the toothed wheel, separates said delivery cell from the pressure fluid supply opening at the moment in which it also separates the delivery cell from the relieving space. As the case may be, the delivery cell should separate from the pressure fluid supply directly before separating from the relieving space. In a preferred embodiment, the loaded delivery cell is separated from the pressure fluid supply just as it is overlapped across its entire axial length by the radial sealing gap, i.e. when a radial sealing gap is formed across its entire length. Although a number of delivery cells per toothed wheel can be simultaneously pre-loaded in accordance with the invention, the pressure fluid supply feed opening preferably exhibits an extension in the rotational direction such that only one delivery cell of a toothed wheel or per toothed wheel is situated in the area of the opening during rotational movement.

In one development of the pump, the inlet leading into the gear chamber is formed as a nozzle through which the suctioned fluid is accelerated, in addition to the suction effect of the mating toothed wheels, towards the still open tooth gap spaces of the toothed wheels. The narrowest portion of the nozzle is preferably defined between the end edges of the radial sealing stays projecting into the suction area in the circumferential direction of the radial sealing stays. Due to the pressure fluid supply into the enclosure area in accordance with the invention, the radial sealing stays on the low pressure side can be extended further towards the toothed mesh than in the prior art. By extending the radial sealing stays in this way, the nozzle can be made advantageously narrow at its narrowest portion.

While forming the nozzle co-operates particularly advantageously with loading the delivery cells in accordance with the invention, it does however shift the onset of cavitation to higher speeds just on its own, without the pressure fluid supply. The Applicant therefore reserves the right to also claim the nozzle which increases the degree of filling, without the pressure fluid supply in accordance with the invention.

In another development, the radial sealing gap is flared, preferably gradually flared, between at least one of the toothed wheels and the enclosing radial sealing stay, on at least one of its two gap ends. Preferably, both gap ends are flared. If only one of the gap ends is flared, the flared gap end is preferably the gap end on the high pressure side. Flaring on the high pressure side equalises pressure differences between the high pressure side of the gear chamber outside the enclosure area and the delivery cells still situated in the enclosure area, over a greater rotational angle range into the enclosure than in the case of a radial sealing gap which is uniformly wide over its circumference. Flaring the radial sealing gap towards the suction area enables the relative speed existing in the circumferential direction between the toothed wheel and the enclosing radial sealing stay to likewise be equalised over a longer distance measured in the circumferential direction than in the case of a radial sealing gap which exhibits a constant width in the circumferential direction. In its narrowest portion, which can be a line or can be extended in the circumferential direction, the radial sealing gap can exhibit the usual radial width in order to ensure separation of the high pressure side and low pressure side. In a particularly preferred embodiment, the radial sealing stay or all the radial sealing stays each form a smooth, cylindrical but not circular cylindrical sealing surface, such that a narrowest portion of the radial sealing gap is provided only along a single tooth tip, and proceeding from there a gradual flaring, preferably in both circumferential directions.

While flaring the radial sealing gap at the end section or both end sections advantageously co-operates with the pressure fluid supply in accordance with the invention, and also advantageously co-operates with the nozzle effect in accordance with the invention, it also however reduces the problems arising from cavitation just on its own or in combination with one or the other of the two aforementioned measures. Both comparatively equalising the pressure on the high pressure side and comparatively equalising the speed on the low pressure side more smoothly, each alone or in combination, reduces the movement and swirling of the fluid in the delivery cells, as a consequence of which the formation of bubbles and therefore cavitation is reduced. The Applicant reserves the right to claim the flaring of a gap end in its own right, i.e. also without the pressure fluid supply in accordance with the invention and/or without forming a nozzle in accordance with the invention.

BRIEF DESCRIPTION OF THE SEVERAL VIEWS OF THE DRAWINGS

A preferred example embodiment of the invention will now be explained by way of figures. Features disclosed by the example embodiment, each individually and in any combination of features, further develop the subjects of the claims and the embodiments described above in a preferred way. There is shown:

DETAILED DESCRIPTION OF THE INVENTION

Figure 1:
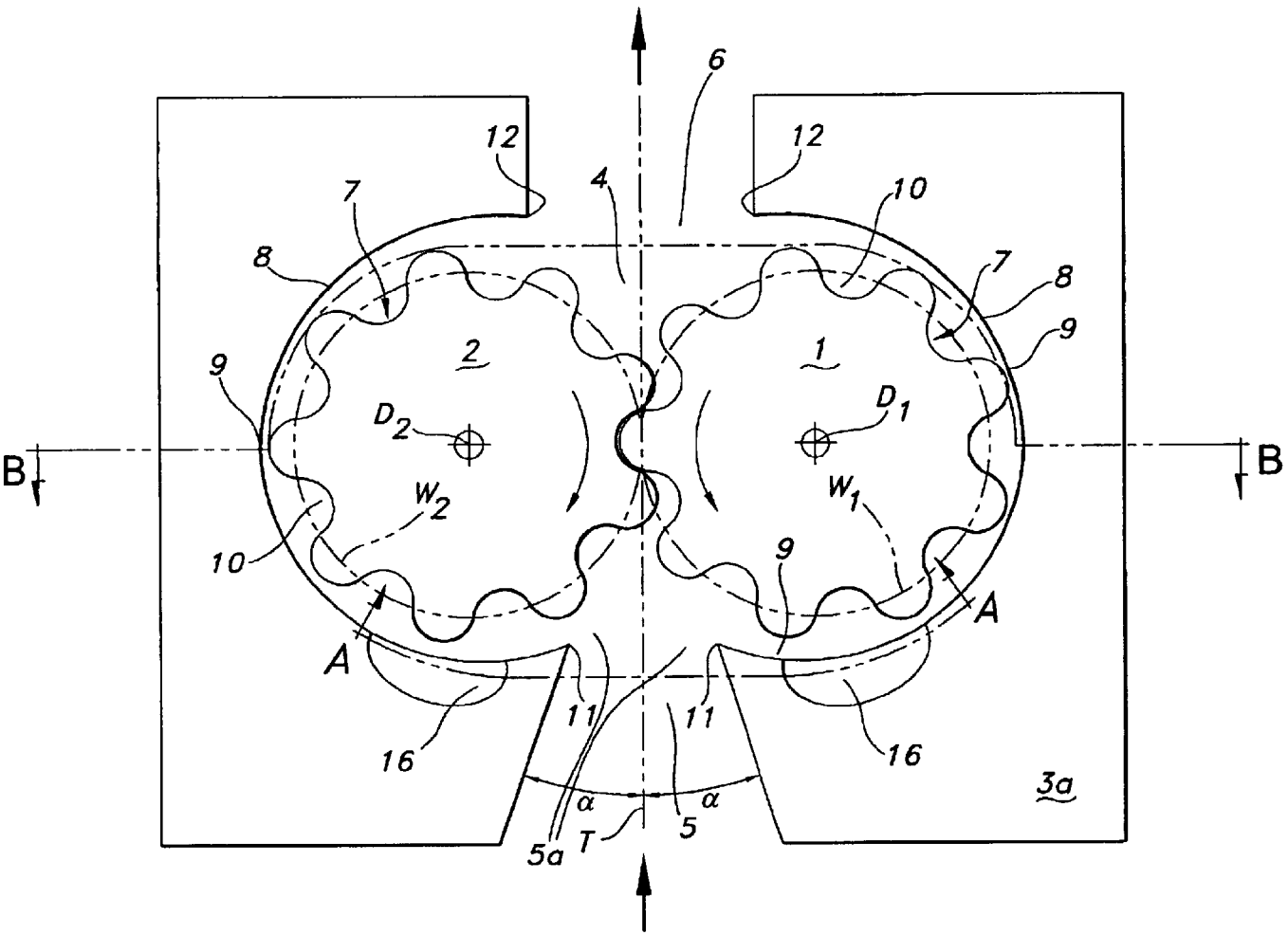
FIG. 1 an external gear pump in a facing view onto the toothed wheels of the pump.

FIG. 1 shows an external gear pump, i.e. an external axis gear pump, in a facing view which provides a view onto the facing sides of two toothed wheels 1 and 2 in a casing part 3*a* of the pump. The two toothed wheels 1 and 2 are rotationally mounted about parallel rotational axes $D_1$ and $D_2$. Each of the toothed wheels 1 and 2 has an external helical toothing and, when they are rotationally driven, are in a mating, toothed mesh via their external toothings. The toothed wheel 1 is rotationally driven and drives the toothed wheel 2 via the toothed mesh. Directional arrows indicate the rotational directions of the toothed wheels 1 and 2. The pitch circles $W_1$ and $W_2$ of the toothed wheels 1 and 2 are also drawn in.

Figure 3:
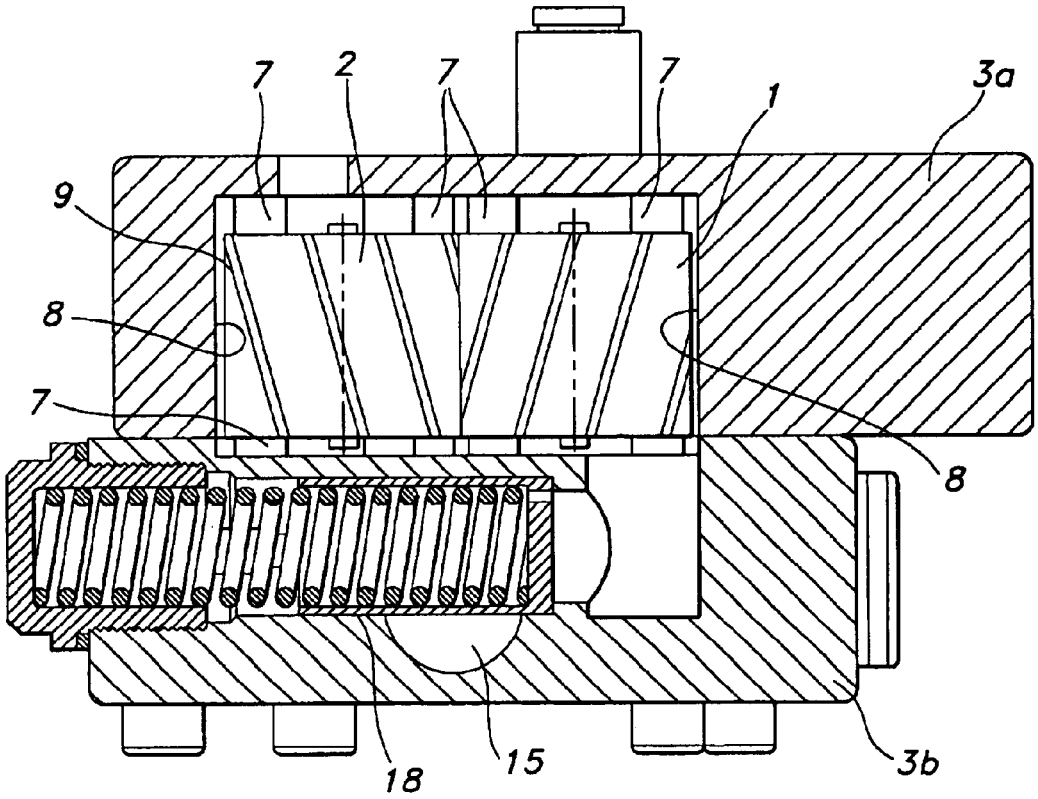
FIG. 3 the external gear pump in a partial longitudinal section with a side view onto the toothed wheels (B—B of FIG. 1).

The casing part 3*a* forms part of a gear chamber 4 in which the toothed wheels 1 and 2 are accommodated. The pump casing as a whole is in two parts consisting of the casing part 3*a* and a casing cover 3*b* (FIG. 3). The casing part 3*a* forms an axial sealing stay 7 for each of the toothed wheels 1 and 2, wherein said axial sealing stay 7 axially opposes the rear-facing side of the corresponding toothed wheel 1 or 2 and is covered by the corresponding toothed wheel 1 or 2 when it is rotationally driven. The casing cover 3*b* likewise forms an axial sealing stay 7 (FIG. 3), axially opposed to each of the front facing sides of the toothed wheels 1 and 2 in FIG. 1. The casing part 3*a* shown in FIG. 1 further forms one radial sealing stay 8 per toothed wheel 1 and 2, said radial sealing stay 8 radially opposing the corresponding toothed wheel 1 or 2 and enclosing the toothed wheel 1 or 2 corresponding to it over a particular arc section, such that a radial sealing gap 9 remains between the tips of the teeth of the toothed wheels 1 and 2 and the radial sealing stay 8 in each case.

When the toothed wheels 1 and 2 are rotationally driven, a fluid to be delivered by the pump is suctioned through an inlet 5 of the gear chamber 4. The suctioned fluid is transported in the tooth gap spaces of the external toothings of the toothed wheels 1 and 2 by the rotational movement along the respectively corresponding radial sealing stay 8 to an outlet 6 of the gear chamber 4, and flows off from there at an increased pressure due to the toothed mesh. A part of the gear chamber 4 comprising the inlet 5 correspondingly forms a low pressure side of the gear chamber 4 and a part of the gear chamber 4 comprising the outlet 6 defined by end edges 12, forms a high pressure side of the gear chamber 4. The axial sealing gaps at the facing sides of the toothed wheels 1 and 2 and the radial sealing gaps 9 formed around the external circumference of the toothed wheels 1 and 2 seal the high pressure side off sufficiently from the low pressure side, such that the required pressure difference from the high pressure side to the low pressure side is formed. The teeth of the toothed wheels 1 and 2 together with the enclosing radial sealing stays 9 define delivery cells 10 moving at the rotational speed of the toothed wheels 1 and 2, in which cells the fluid is transported from the low pressure side to the high pressure side, essentially in portions.

If the speed of the toothed wheels 1 and 2 increases, the centrifugal forces acting on the fluid in the tooth gap spaces and the delivery cells 10 increase. On the low pressure side of the gear chamber 4, outside the enclosure formed by the radial sealing stays 9, the centrifugal forces reduce the degree of filling there in the outwardly open tooth gap spaces, with increasing speed. The fluid suctioned on the low pressure side by the toothed mesh is, so to speak, spun out of the tooth gap spaces which open from the point of maximum toothed mesh in the rotational direction, if the speed could be correspondingly high. When operating the pump in practice, the fluid is not actually accelerated out of the tooth gap spaces, however the fluid in the tooth gap spaces which is carried along during rotational movement acquires a speed component which counteracts the speed due to the suction effect alone and therefore reduces the degree of filling, firstly of the tooth gap spaces and then in the enclosure area of the delivery cells 10. More serious still than the reduction in the degree of filling, however, is the increased cavitation due to the centrifugal effect of the centrifugal forces, which causes unpleasant noise and leads to material fatigue on the tooth contours of the toothed wheels 1 and 2.

In order to increase the pressure in the delivery cells 10 and therefore reduce cavitation, fluid from the high pressure side of the pump, which incorporates the high pressure side of the gear chamber 4, is fed back through a pressure fluid supply to the low pressure side of the gear chamber 4, into each of the two enclosure areas of the toothed wheels 1 and 2.

A branched reflux conduit 15, which may be seen in FIG. 3, forms the pressure fluid supply. The reflux conduit 15 is formed in the casing cover 3*b*. On the high pressure side in the area of the outlet 6, it opens into the pressure fluid flowing off. It extends from its opening on the high pressure side, initially single-branched, up to a branching point where it branches into two conduit branches. One of the two conduit branches opens into an inflow opening 16 of the radial sealing stay 8 of the toothed wheel 1, and the other conduit branch opens into a similar inflow opening 16 of the radial sealing stay 8 of the other toothed wheel 2. The term inflow opening is derived from the inflow into the delivery cells 10. The two inflow openings 16 are pocket-like recesses in the inner surface areas of the radial sealing stays 8 formed by the casing part 3*a*. The inflow openings 16 extend up to the facing side of the casing part 3*a*, which is sealed off by the casing cover 3*b* and at which the conduit branches open, i.e. end. The inflow openings 16 are arranged in the radial sealing stays 8 and shaped such that for each of the toothed wheels 1 and 2, the pressure fluid only flows into one delivery cell 10 or an axial section of one delivery cell 10 for which the trailing tooth tip of the immersed delivery cell 10 already forms a radial sealing gap 9 with the corresponding radial sealing stay 8, such that the pressure fluid from the inflow opening 16 flows at least essentially only axially, i.e. along the teeth. This ensures that the pressure fluid does not simply flow off into the suction area of the tooth gap spaces which are still free from the radial sealing stay 8. In order to expel the fluid of the low pressure side, suctioned beforehand and still contained in the delivery cell 10 which is currently to be preloaded, as completely as possible and to correspondingly pre-load the delivery cell 10 effectively with the pressure fluid, it is ensured that this low pressure fluid can escape from the delivery cell 10.

Figure 2:
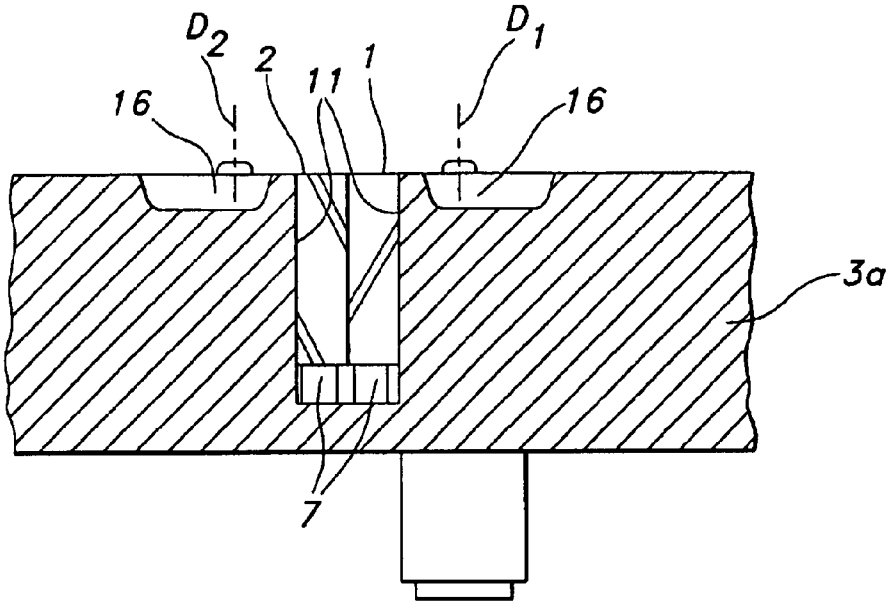
FIG. 2 the external gear pump in the longitudinal section A—A of FIG. 1.

Since the toothed wheels 1 and 2 have a helical toothing, the low pressure fluid can, as shown by way of example in FIG. 2, be expelled in a structurally particularly simple way. The two inflow openings 16 are each positioned in their radial sealing stay 8 and extended in the rotational direction of the corresponding toothed wheel 1 or 2 such that the pressure fluid being fed back flows into the tooth gap space entering the enclosure at a leading axial end of the helical toothing and the low pressure fluid can escape to the low pressure side via an end edge 11 of the sealing stay 8, at a trailing axial end of the same tooth gap space. The end edges 11 are extended axially such that the helical toothings point at an angle to the end edges 11 and the leading axial ends of the tooth gap spaces therefore enter the enclosure before the trailing axial ends. In the example embodiment, the end edges 11 are simply parallel to the rotational axes of the toothed wheels 1 and 2. The trailing tooth of the immersing tooth gap space separates the respective inflow opening 16 from the inlet 5 and the free suction area between the toothed wheels 1 and 2. In FIG. 1, the radial sealing gap 9 is shown wider than it really is in actually implemented pumps. In reality, even in the enclosure area which is connected to the suction area, the sealing gap 9 is brought up so closely to the toothing that high pressure fluid being fed back can escape in the circumferential direction, against the rotational direction of the toothed wheels 1 and 2, into the suction area only in practically negligible amounts. In this sense, the immersing tooth gap space already forms, in the axial area into which the respective inflow opening 16 opens, a delivery cell 10 situated in the enclosure, but with a relieving space 5*a* connected to the delivery cell 10. The suction area, in particular the suction area around the inlet opening of the inlet 5 defined by the end edges 11 of the sealing stay 8, forms the relieving space 5*a*, up to the point of toothed mesh of the toothed wheels 1 and 2 as the case may be. Furthermore, each of the inflow openings 16 is positioned in its radial sealing stay 8 and extended in the rotational direction of the corresponding toothed wheel 1 or 2 such that the trailing tooth which defines the delivery cell 10 only forms a radial sealing gap 9 with the radial sealing stay 8 along its full length when it seals the delivery cell 10, which in this way enters the enclosure area along its entire axial length, off from the inflow opening 16, i.e. when its radially outermost surface, generally its crown line, has completely passed the inflow opening 16.

If the two toothed wheels 1 and 2 had linear toothings, then in an otherwise unchanged embodiment for expelling the low pressure fluid, a recess opening into the suction area could for example be provided in each of the axial sealing stays 7 which are formed at the facing sides of the toothed wheels 1 and 2 facing axially away from the inflow openings 16, through which recess the low pressure fluid can escape from the delivery cell 10 in question, into the suction area.

The pump of the example embodiment is a lube oil pump for supplying an internal combustion linear piston motor with lube oil. The pump, i.e. its driven toothed wheel 1, is driven in the usual way, for example by the crankshaft of the motor, directly or via a transmission. Due to its essentially constant specific delivery volume, its absolute delivery volume increases essentially in proportion to the speed. Once a particular motor speed is reached, the pump therefore delivers more than the motor requires, if it is not regulated. A pressure regulating valve 18 is therefore arranged in the casing cover 3*b* on the high pressure side of the pump, said valve connecting the high pressure side to the reflux conduit 15, through which the excess lube oil of the high pressure side is directed into the inflow openings 16 and into the delivery cells 10, once said speed is reached. The oil delivered surplus to requirement is circulated between the inlet 5 and the outlet 6. Pre-loading the delivery cells 10 therefore not only shifts the onset of cavitation to higher speeds but also results in the delivery volume of the pump being regulated in accordance with the requirement.

In order to increase the speed of the fluid flowing in through the inlet 5 and the gear chamber 4 and therefore also to counteract the centrifugal forces, the inlet 5 is formed as a nozzle. To this end, the flow cross-section of the inlet 5 is continuously reduced up to the inlet opening of the gear chamber 4. In the example embodiment, the inlet 5 narrows like a wedge right up to the inlet opening which is defined on both sides by the end edges 11 and extends over the entire axial width of the toothed wheels 1 and 2. This extension of the narrowest cross-section of the nozzle is determined by the end edges 11 which point exactly axially for expelling the low pressure fluid, but is not restricted to this. The inlet opening into the gear chamber 4, bordered by the end edges 11, is the narrowest flow cross-section of the nozzle. From this inlet opening, the nozzle continuously widens counter to the flow direction, with a constant aperture angle of $2\alpha$. The nozzle is axially symmetrical with respect to a common tangent T to the pitch circles $W_1$ and $W_2$ of the toothed wheels 1 and 2, said pitch circles rolling off onto each other.

Lastly, cavitation is also counteracted by the fact that the two radial sealing gaps 9 are each widened towards the gap end on the high pressure side and the gap end on the low pressure side of the gear chamber 4. Proceeding from a narrowest portion, the radial gaps 9 each widen continuously towards their two gap ends, which are end edges 11 and 12 respectively. The narrowest portion is formed on the extension of the connecting straight line of each of the rotational axes $D_1$ and $D_2$ between the radial sealing stays 8 and the teeth of the toothed wheels 1 and 2. In the area of this narrowest portion, the radial width of the sealing gaps 9 can correspond to the radial widths of conventional sealing gaps. In any event, the separation of the high pressure side from the low pressure side of the gear chamber 4 must be ensured by the radial sealing gaps 9.

By widening on the low pressure side of the gear chamber 4, speed equalisation between the fluid on or near the toothing surface and the fluid on or near the opposing radial sealing stay 8 is extended into the enclosure in the rotational direction of the toothed wheels 1 and 2. The speed differences arising from wall friction are gradually and therefore continuously equalised. As a result, the shearing stress peaks and whirling in the fluid are also reduced. Widening on the high pressure side of the radial gaps 9 leads to pressure equalisation between the high pressure side of the gear chamber 4 and the delivery cells 10 situated in the enclosure being extended into the enclosure over a greater distance, counter to the flow direction, such that the fluid in the delivery cells 10 is specifically also calmed, and cavitation therefore counteracted, at the gap end of the high pressure side.

What is claimed is:

1. An external gear pump, comprising:

a) a casing;

b) a gear chamber formed in said casing, comprising an inlet for a fluid on a low pressure side and an outlet for the fluid on a high pressure side and comprising axial sealing stays and radial sealing stays;

c) a first toothed wheel which is adapted to be rotated in the gear chamber, comprising an external toothing;

d) a second toothed wheel which is adapted to be rotated in the gear chamber, comprising an external toothing which is in a toothed mesh with said external toothing of said first toothed wheel;

e) wherein said external toothings form delivery cells in which the fluid is transported from said inlet to said outlet and which are axially sealed off by said axial sealing stays and radially sealed off by said radial sealing stays;

f) and at least one pressure fluid supply through which pressure fluid is adapted to be supplied to said low pressure side;

g) wherein said at least one pressure fluid supply opens on the low pressure side into a delivery cell which is radially sealed off by one of the radial sealing stays;

h) and wherein a relieving space is formed which is connected to the low pressure side of the pump and opens into the same delivery cell of the external toothing as the pressure fluid supply and into which the pressure fluid expels the fluid of the low pressure side contained in the delivery cell.

2. The external gear pump as set forth in claim 1, wherein the pressure fluid supply has a fluid connection to the high pressure side of the pump, in order to feed back a part of the fluid of the high pressure side.

3. The external gear pump as set forth in claim 2, wherein a regulating or cut-off device is arranged in the pressure fluid supply, said device only opening the pressure fluid supply once a particular fluid pressure or a particular pump speed or a particular value of another variable which is characteristic for operating the pump is reached.

4. The external gear pump as set forth in claim 1, wherein the pressure fluid supply opens in the axial sealing stay.

5. The external gear pump as set forth in claim 1, wherein the pressure fluid supply opens in the radial sealing stay.

6. The external gear pump as set forth in claim 1, wherein the pressure fluid supply opens into an axial end section of the delivery cell.

7. The external gear pump as set forth in claim 1, wherein a suction area comprising the inlet forms said relieving space.

8. The external gear pump as set forth in claim 1, wherein the pressure fluid supply and the relieving space are simultaneously separated from the delivery cell filled with the pressure fluid, when the toothed wheels are rotationally moved.

9. The external gear pump as set forth in claim 1, wherein the teeth of the external toothing filled with the pressure fluid and the end edge of the radial sealing stay, said edge facing the inlet and said radial sealing stay enclosing the external toothing filled with the pressure fluid, point to each other such that the tooth gap spaces of the external toothing each form a leading axial section with respect to said end edge and a trailing axial section with respect to said end edge, which sequentially move into the overlap with the radial sealing stay, when the toothed wheels are rotationally moved, and wherein the pressure fluid supply opens into said leading axial section.

10. The external gear pump as set forth in claim 1, wherein the inlet forms a nozzle, in order to accelerate the fluid flowing in, towards the toothed wheels.

11. The external gear pump as set forth in claim 10, wherein the radial sealing stays comprise end edges, between which the inlet is defined and which form a narrowest portion of said nozzle.

12. The external gear pump as set forth in claim 10, wherein the nozzle is formed symmetrically with respect to both sides of a common tangent to the pitch circles of the toothed wheels.

13. The external gear pump as set forth in claim 1, wherein a radial sealing gap formed between one of the toothed wheels and one of the radial sealing stays is radially widened at an at least one gap end.

14. The external gear pump as set forth in claim 13, wherein the at least one gap end of the high pressure side is widened.

15. The external gear pump as set forth in claim 13, wherein the at least one gap end of the low pressure side is widened.

16. The external gear pump as set forth in claim 13, wherein the radial sealing gap continuously widens towards at least one gap end.

* * * * *